US008208663B2

(12) United States Patent
Jeong et al.

(10) Patent No.: US 8,208,663 B2
(45) Date of Patent: Jun. 26, 2012

(54) APPARATUS FOR POSITIONING SCREEN SOUND SOURCE, METHOD OF GENERATING LOUDSPEAKER SET INFORMATION, AND METHOD OF REPRODUCING POSITIONED SCREEN SOUND SOURCE

(75) Inventors: So-young Jeong, Seoul (KR); Jung-ho Kim, Yongin-si (KR); Jeong-su Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 439 days.

(21) Appl. No.: 12/482,883

(22) Filed: Jun. 11, 2009

(65) Prior Publication Data

US 2010/0111336 A1 May 6, 2010

(30) Foreign Application Priority Data

Nov. 4, 2008 (KR) ..... 10-2008-0108839

(51) Int. Cl.
*H04R 5/02* (2006.01)

(52) U.S. Cl. ..... 381/306; 348/738

(58) Field of Classification Search ..... 381/306, 381/300, 302, 303, 305, 308, 27, 1, 77, 80, 381/81, 85, 61, 89, 98, 738
See application file for complete search history.

(56) References Cited

U.S. PATENT DOCUMENTS

| | | | | |
|---|---|---|---|---|
| 2006/0044419 | A1* | 3/2006 | Ozawa | 348/231.99 |
| 2007/0104341 | A1* | 5/2007 | Kondo et al. | 381/306 |
| 2008/0019534 | A1* | 1/2008 | Reichelt et al. | 381/17 |
| 2008/0165992 | A1* | 7/2008 | Kondo et al. | 381/182 |

FOREIGN PATENT DOCUMENTS

| | | |
|---|---|---|
| JP | 2006-067295 | 3/2006 |
| JP | 2007-081928 | 3/2007 |
| JP | 2008-079065 | 4/2008 |
| JP | 2008-109209 | 5/2008 |
| KR | 10-0284768 | 12/2000 |

* cited by examiner

*Primary Examiner* — Vivian Chin
*Assistant Examiner* — David Ton
(74) *Attorney, Agent, or Firm* — NSIP Law

(57) ABSTRACT

An apparatus for positioning a screen sound source, a method of generating loudspeaker set information for screen sound source positioning, and a method of reproducing a positioned screen sound source are provided. The apparatus and methods relate to a screen sound source positioning technique. A plurality of loudspeakers, each configured to have approximately the same gain, are each disposed proximate to the edge of a display, and a loudspeaker set including at least two of the loudspeakers is selected to position a virtual sound source substantially synchronized with a visual object displayed at a position on the screen of the display. Accordingly, a virtual sound source may be positioned at a certain specific position on the screen of a display without sound source distortion.

16 Claims, 6 Drawing Sheets

| Position | Loudspeaker Set |
|---|---|
| ⋮ | ⋮ |
| B | 6,20 |
| ⋮ | ⋮ |
| A | 3,15,20 |
| | |

APPARATUS FOR POSITIONING SCREEN SOUND SOURCE, METHOD OF GENERATING LOUDSPEAKER SET INFORMATION, AND METHOD OF REPRODUCING POSITIONED SCREEN SOUND SOURCE

CROSS REFERENCE TO RELATED APPLICATION(S)

This application claims the benefit under 35 U.S.C. §119 (a) of a Korean Patent Application No. 10-2008-108839, filed Nov. 4, 2008 in the Korean Intellectual Property Office, the disclosure of which is incorporated herein in its entirety by reference for all purposes.

BACKGROUND

1. Field

The following description relates to an apparatus for positioning a screen sound source, a method of generating loudspeaker set information for screen sound source positioning, and a method of reproducing a positioned screen sound source, and more particularly, to a technique for reproducing a virtual sound source spatially synchronized with a visual object shown on a display.

2. Description of the Related Art

With the proliferation of large-screen displays, demand for enhancing the user listening experience by spatially matching an image with a sound source has increased and prompted research regarding spatial matching.

In order to spatially match an image with a sound source on a screen, a plurality of loudspeakers are two-dimensionally disposed on or behind the screen of a display, and a sound source is reproduced through a loudspeaker corresponding to a specific screen position.

This method can generate a sound source at an accurate position of a visual object shown on the screen of the display, but a large number of loudspeakers may be required to generate a sound source at a position on the screen of the display with high resolution.

In addition, the method may separately drive a large number of loudspeakers disposed two-dimensionally on or behind the screen of the display. Thus, an amplifier and controller for separately controlling the large number of loudspeakers have complex constitutions, the output powers of the loudspeakers are low, and low and high frequencies are separately processed.

For these reasons, the method may be employed in, for example, a theater which provides a large space behind the screen, but the method may be difficult to use in a small-scale display, for example, a household flat panel television (TV) whose front is made of glass.

SUMMARY

In one general aspect, an apparatus for positioning a screen sound source includes a plurality of loudspeakers, each disposed proximate to the edge of a display and each configured to have approximately the same gain, and a controller for selecting a loudspeaker set, including at least two of the loudspeakers, to position a virtual screen sound source substantially synchronized with a visual object displayed at a position on a screen of the display.

The controller may select the loudspeaker set with reference to loudspeaker set information configured according to the position of the visual object on the screen of the display.

The controller may select the loudspeaker set with respect to the loudspeaker set including loudspeakers disposed at vertices of a virtual polygon whose centroid is at the position of the visual object on the screen of the display.

If a plurality of loudspeaker sets includes loudspeakers disposed at vertices of a virtual polygon whose centroid is at the position of the visual object on the screen of the display, the controller may further select the loudspeaker set having the shortest distance between the visual object and each of the loudspeakers If a plurality of loudspeaker sets includes loudspeakers disposed at vertices of a virtual polygon whose centroid is at the position of the visual object on the screen of the display, the controller may further select the loudspeaker set having the lowest of maximum angles between a virtual screen sound source reference vector from a user to the visual object and virtual loudspeaker vectors from the user to each of the loudspeakers.

If a plurality of loudspeaker sets includes loudspeakers disposed at vertices of a virtual polygon whose centroid is at the position of the visual object on the screen of the display, the controller may further select the loudspeaker set having the lowest sum of angles between a virtual screen sound source reference vector from a user to the visual object and virtual loudspeaker vectors from the user to each of the loudspeakers of each loudspeaker set.

If a plurality of loudspeaker sets includes loudspeakers disposed at vertices of a virtual polygon whose centroid is at the position of the visual object on the screen of the display, the controller may further select the loudspeaker set having the lowest average of angles between a virtual screen sound source reference vector from a user to the visual object and virtual loudspeaker vectors from the user to each of the loudspeakers of each loudspeaker set.

If a plurality of loudspeaker sets includes loudspeakers disposed at vertices of a virtual polygon whose centroid is at the position of the visual object on the screen of the display, the controller may further select the loudspeaker set having the smallest area of a virtual polygon formed by connecting each of the loudspeakers included in the loudspeaker set.

The controller may select a loudspeaker set including two loudspeakers, wherein the two loudspeakers each have approximately the same distance from the visual object on the screen of the display, and the two loudspeakers and the visual object on the screen of the display are substantially disposed in a straight line.

If no loudspeaker set includes loudspeakers disposed at vertices of a virtual polygon whose centroid is at the position of the visual object on the screen of the display, the controller may select a loudspeaker set including loudspeakers disposed at vertices of a virtual polygon whose centroid is nearest to the position of the visual object.

The controller may adjust output gains of the loudspeakers included in the selected loudspeaker set.

In another general aspect, a method of generating loudspeaker set information for screen sound source positioning includes selecting a screen size and a virtual screen sound source resolution, calculating a resolution of a virtual screen sound source generated on a screen of a display with respect to a variable number and a variable position of a plurality of loudspeakers disposed proximate to the edge of the display and each configured to have approximately the same gain, comparing the calculated virtual screen sound source resolution with the selected virtual screen sound source resolution, and, according to the result, determining if a virtual screen sound source having the selected virtual screen sound source resolution is generated, if it is determined that a virtual screen sound source having the set virtual screen sound source resolution is generated, further determining a quantity and positions of loudspeakers for the selected screen size, and storing loudspeaker set information according to each position on the screen of the display having the selected screen size and virtual screen sound source resolution.

The method may further include determining if a plurality of loudspeaker sets generates a virtual screen sound source at each position on the screen of the display having the selected screen size and virtual screen sound source resolution.

If it is determined that a plurality of loudspeaker sets generate a virtual screen sound source at a certain position, one of the loudspeaker sets may be selected.

In another general aspect, a method of reproducing a positioned screen sound source includes in response to a sound source being input, determining a position of a virtual screen sound source on a screen of a display, in response to the virtual screen sound source position being determined, selecting a loudspeaker set including at least two loudspeakers corresponding to the determined virtual screen sound source position, with reference to loudspeaker set information for screen sound source positioning, and outputting the sound source through the loudspeakers included in the selected loudspeaker set.

In another general aspect, a method of reproducing a positioned screen sound source includes in response to a sound source being input, determining a position of a virtual screen sound source on a screen of a display, determining if a loudspeaker set includes loudspeakers disposed at vertices of a virtual polygon whose centroid is at the determined virtual screen sound source position, if it is determined that a loudspeaker set includes loudspeakers disposed at vertices of a virtual polygon whose centroid is at the determined virtual screen sound source position, selecting the loudspeaker set, and outputting the sound source through the loudspeakers included in the selected loudspeaker set.

If a plurality of loudspeaker sets includes loudspeakers disposed at vertices of a virtual polygon whose centroid is at the virtual screen sound source position, selecting the loudspeaker set includes selecting one of the loudspeaker sets.

The method may further include determining if two loudspeakers each have approximately the same distance from the determined virtual screen sound source position, and determining if the two loudspeakers and the determined virtual screen sound source position are substantially disposed in a straight line.

If it is determined that no loudspeaker set includes loudspeakers disposed at vertices of a virtual polygon whose centroid is at the determined virtual screen sound source position, a loudspeaker set including loudspeakers disposed at vertices of a virtual polygon whose centroid is nearest to the determined virtual screen sound source position may be selected.

If the loudspeaker set including loudspeakers disposed at vertices of a virtual polygon whose centroid is nearest to the virtual screen sound source position is selected, output gains of the loudspeakers included in the selected loudspeaker set are adjusted.

Other features and aspects will be apparent from the following detailed description, the drawings, and the claims.

Figure 1:
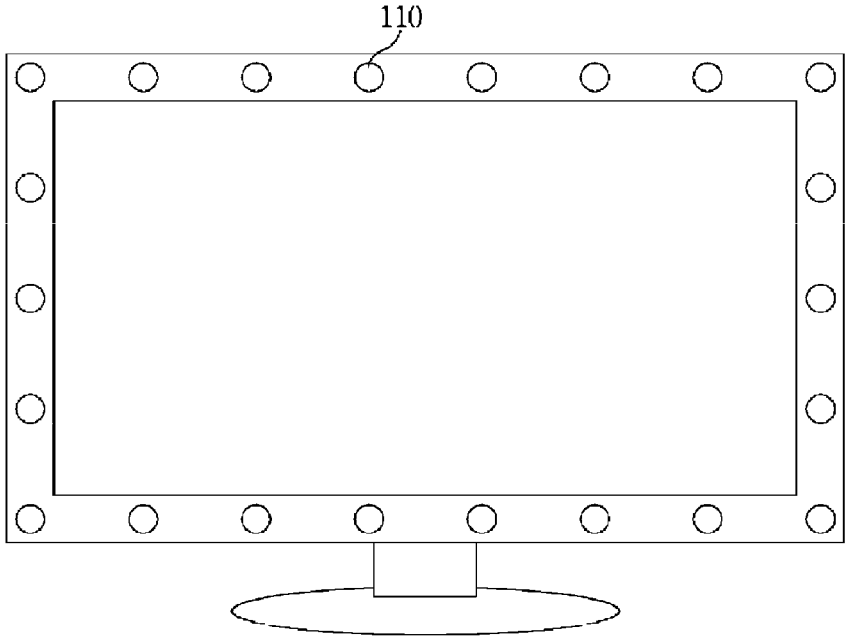
FIG. 1 is a diagram illustrating an exemplary arrangement of loudspeakers.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. Also, descriptions of well-known functions and constructions may be omitted for increased clarity and conciseness. In a small-scale display such as a household flat panel television (TV) whose front is made of glass, due to spatial limitations, it is difficult to two-dimensionally dispose a plurality of loudspeakers on or behind a screen of the display and spatially match an image with a sound source by reproducing the sound source using a loudspeaker corresponding to a specific position on the screen. To minimize spatial limitations, a plurality of loudspeakers may be disposed outside the screen of the display, and some of the loudspeakers may be selected to reproduce a sound source that spatially matches the location of an image.

Here, a wave-field synthesis (WFS) method of disposing actual loudspeakers at positions different from a sound source, calculating sound wave propagation, and generating the sound may be used. However, while the method may be appropriate for positioning a sound source in a three-dimensional (3D) space, and it may not be desirable for a small-scale display such as a household flat panel TV whose front is made of glass. In comparison, an amplitude panning method may involve less computation and thus may be appropriate for positioning a sound source in a two-dimensional (2D) space.

Accordingly, according to one aspect, there is provided an exemplary amplitude panning method to position a virtual screen sound source at a specific position on a screen of a display.

While a vector-based amplitude panning (VBAP) method may spatially match an image with a sound source by adjusting the gains of a plurality of loudspeakers, the exemplary amplitude panning method may select at least two of a plurality of loudspeakers set to have the same gain so as to position a virtual screen sound source in substantial synchronization with a visual object displayed at a specific position on a screen of a display.

The exemplary amplitude panning method may be defined as a speaker selection-based amplitude panning (SSAP) method. This and other features and aspects follows.

Figure 2:
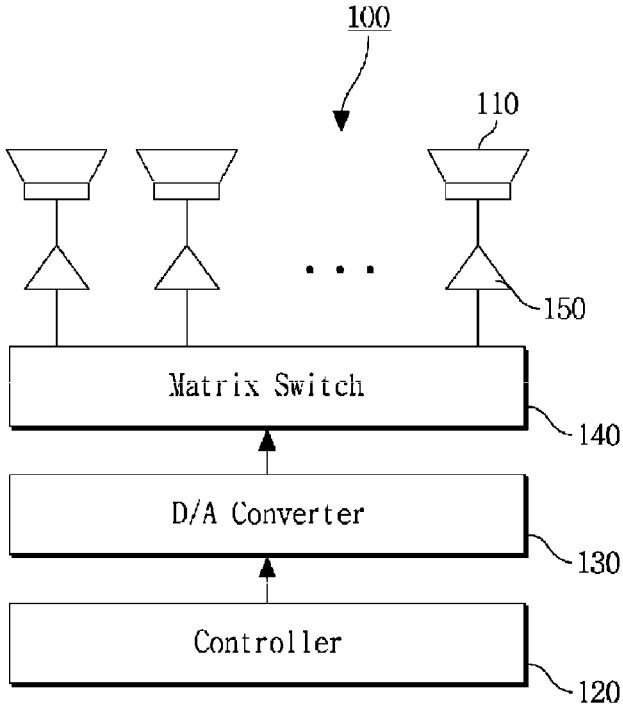
FIG. 2 is a diagram illustrating an exemplary apparatus for positioning a screen sound source.

FIG. 1 illustrates an exemplary arrangement of loudspeakers, and FIG. 2 illustrates an exemplary apparatus 100 for positioning a screen sound source. The screen sound source positioning apparatus 100 according to one example includes a plurality of loudspeakers 110 and a controller 120.

The loudspeakers 110 are installed at the periphery of a display and set to have the same gain. When loudspeakers have the same gain, the amplification of sound output through the loudspeakers is the same. The loudspeakers 110 are illustrated as being installed at regular intervals, but they may be installed at irregular intervals.

The controller 120 selects a loudspeaker set, including at least two of the loudspeakers 110, to position a virtual screen sound source in synchronization with a visual object displayed at a certain position on the screen of the display.

Here, the controller 120 may be implemented to select the loudspeaker set using two methods. The first method is a lookup table-based loudspeaker set selection method of storing, in advance, information on loudspeaker sets configured according to position of the visual object on the screen of the display and selecting a loudspeaker set with reference to the stored loudspeaker set information.

The second method is a real-time computation-based loudspeaker set selection method of determining, in real time, optimal loudspeakers for positioning a virtual screen sound source at the position of a visual object displayed on the screen of the display and selecting a loudspeaker set. These methods are described herein.

Figures 3, 4:
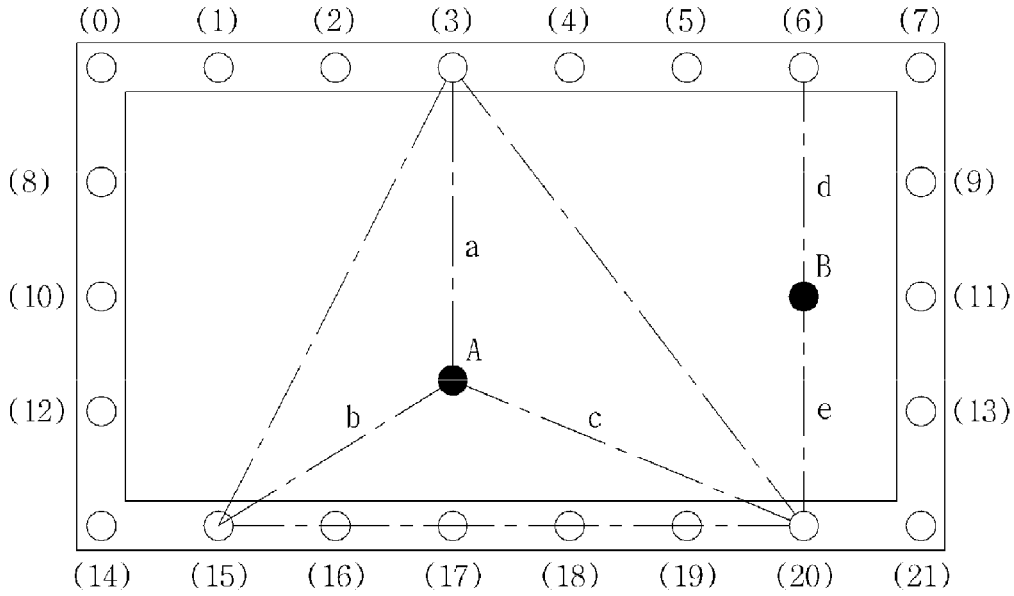
FIG. 3 is a diagram illustrating an exemplary scheme of selecting loudspeakers for screen sound source positioning.
FIG. 4 is a table illustrating exemplary loudspeaker set information.

FIG. 3 illustrates an exemplary scheme of selecting loudspeakers for screen sound source positioning. Using the scheme illustrated in FIG. 3, both of the above-mentioned methods select optimal loudspeakers for positioning a virtual screen sound source at the position of a visual object and store the loudspeaker set information, or select, in real time, optimal loudspeakers for positioning a virtual screen sound source at the position of a visual object.

When two loudspeakers have the same distance from a certain position on the screen of the display and are disposed in a straight line, they are selected as a loudspeaker set. When a distance d between position B and loudspeaker 6 is the same as a distance e between position B and loudspeaker 20 in FIG. 3, speaker 6 and speaker 20 are disposed in a straight line with position B at the middle thereof, and thus are selected as a loudspeaker set.

When no two loudspeakers have the same distance from a certain position on the screen of the display and are disposed in a straight line, loudspeakers disposed at vertices of a virtual polygon whose centroid is at the position of a visual object displayed on the screen of the display are selected as a loudspeaker set. In FIG. 3, when a distance a between position A and loudspeaker 3, a distance b between position A and loudspeaker 15, and a distance c between position A and loudspeaker 20 are the same, position A is at the centroid of a virtual triangle having vertices at speaker 3, speaker 15 and speaker 20, and thus speaker 3, speaker 15 and speaker 20 are selected as a loudspeaker set.

By selecting a loudspeaker set for each position on the screen of the display, as described above, and storing loudspeaker set information, as shown in FIG. 4, or by selecting a loudspeaker set for the position of a visual object shown on the screen of the display as described above, a screen sound source may be positioned. FIG. 4 is a table illustrating exemplary loudspeaker set information.

The screen sound source positioning apparatus 100 according to one example selects at least two of a plurality of loudspeakers installed at the periphery of the display and set to have the same gain and thereby positions a virtual screen sound source in synchronization with the selected loudspeakers with a visual object displayed at a certain position on the screen of the display, such that the virtual screen sound source may be positioned at the specific position on the screen of the display without substantial sound source distortion.

Moreover, even if the position of a visual object shown on the screen of a display varies in real time and another loudspeaker set is selected, a virtual screen sound source may be positioned at a certain position on the screen of the display without sound source distortion because the loudspeakers installed at the periphery of the display are set to have the same gain.

Components in FIG. 2 include a digital-to-analog (D/A) converter 130 for converting digital audio data into analog audio signal, a matrix switch 140 for outputting an analog audio signal through a selected set of loudspeakers among the loudspeakers 110 installed at the periphery of the display, and a plurality of amplifiers 150 for amplifying the analog audio signal such that the loudspeakers 110 installed at the periphery of the display have the same gain.

When a loudspeaker set including at least two of the loudspeakers 110 installed at the periphery of the display is selected by the controller 120, the controller 120 signals the matrix switch 140 to output an analog audio signal output from the D/A converter 130, which converts digital audio data into an analog audio signal, through the selected loudspeaker set. The matrix switch 140 outputs n outputs from m inputs.

The analog audio signal output through the loudspeaker set selected by the matrix switch 140 is amplified by the amplifiers 150, which are the foregoing parts of loudspeakers 110 included in the selected loudspeaker set, and output through the loudspeakers 110 included in the loudspeaker set.

Here, the output powers of the amplifiers 150 amplifying the analog audio signal are set such that the loudspeakers 110 have the same gain. Thus, a virtual screen sound source may be positioned at a certain position on the screen of the display without substantial sound source distortion.

Meanwhile, according to an aspect of the screen sound source positioning apparatus 100 of one example, the controller 120 may select a loudspeaker set including at least two loudspeakers, with reference to loudspeaker set information configured according to the position on the screen of the display.

In other words, one example employs the above-mentioned lookup table-based loudspeaker set selection method. When a visual object is displayed at position A shown in FIG. 3 and a virtual screen sound source is positioned in synchronization with the visual object, the controller 120 selects loudspeakers 3, 15 and 20 shown in FIG. 3 as a loudspeaker set corresponding to position A with reference to loudspeaker set information as shown in FIG. 4.

Position A is at the centroid of a virtual triangle having vertices at speaker 3, speaker 15 and speaker 20, and the distances between respective speakers 3, 15 and 20 and position A are the same. Thus, when a sound source is output through each of speakers 3, 15 and 20 having the same gain, a virtual screen sound source is generated at position A by the spatial effect of loudspeakers 3, 15 and 20, and a user hears the sound source as if it is reproduced without distortion from the visual object displayed at position A at which the virtual screen sound source is generated.

Accordingly, the screen sound source positioning apparatus 100 according to one example selects at least two of a plurality of loudspeakers installed at the periphery of a display and set to have the same gain and thereby positions a virtual screen sound source in synchronization with a visual object displayed at a certain position on the screen of the display, such that the virtual screen sound source may be positioned at the position of the visual object on the screen of the display without sound source distortion.

Moreover, even if the position of a visual object displayed on the screen of a display varies in real time and another loudspeaker set is selected, a virtual screen sound source may be positioned at a certain position on the screen of the display without sound source distortion because the loudspeakers installed at the periphery of the display are set to have the same gain.

Meanwhile, according to one example of the screen sound source positioning apparatus 100, the controller 120 may select a loudspeaker set including loudspeakers positioned at vertices of a polygon whose centroid is at the position of a visual object displayed on the screen of the display.

In other words, one example employs the above-mentioned real-time computation-based loudspeaker set selection method. The positions of the loudspeakers installed at the periphery of the display and set to have the same gain are determined in advance, and information on the position of the visual object also may be obtained. Thus, the controller 120 calculates distances between the position of the visual object and the respective loudspeakers installed at the periphery of the display and determines whether or not the number of loudspeakers having the same distance is three or more. When three or more loudspeakers having the same distance are detected, the controller 120 selects them as a loudspeaker set.

When a visual object is at position A shown in FIG. 3 and a virtual screen sound source is positioned in synchronization with the visual object, distances between position A at which the visual object is displayed and the respective loudspeakers installed at the periphery of the display are calculated, and loudspeakers 3, 15 and 20 having the same distance are detected and selected as a loudspeaker set.

Accordingly, the screen sound source positioning apparatus 100 according to this exemplary embodiment selects at least three of the loudspeakers installed at the periphery of the display and set to have the same gain and thereby positions a virtual screen sound source in synchronization with a visual object displayed at a certain position on the screen of the display, such that the virtual screen sound source may be positioned on the screen of the display without sound source distortion.

Moreover, even if the position of a visual object shown on the screen of a display varies in real time and another loudspeaker set is selected, a virtual screen sound source may be positioned at a certain position on the screen of the display without sound source distortion because all the loudspeakers installed at the periphery of the display are set to have the same gain.

Meanwhile, when a plurality of loudspeaker sets including loudspeakers disposed at vertices of a virtual polygon whose centroid is at the position of a visual object displayed on the screen of a display are detected, all the detected loudspeaker sets may be used. However, a distance between loudspeakers included in a loudspeaker set and the visual object may be different from a distance between loudspeakers included in another loudspeaker set and the visual object, and thus the sound source may be distorted due to a difference between the distances.

Therefore, to prevent distortion of the sound source, when a plurality of loudspeaker sets include loudspeakers disposed at vertices of a virtual polygon whose centroid is at the position of a visual object displayed on the screen of a display, one of the loudspeaker sets is selected to reproduce the sound source.

In the screen sound source positioning apparatus 100 according to one example, when a plurality of loudspeaker sets include loudspeakers disposed at vertices of a virtual polygon whose centroid is at the position of a visual object displayed on the screen of a display, the controller 120 selects a loudspeaker set having the shortest distance between the visual object and the respective loudspeakers thereof. Thus, the screen sound source positioning apparatus 100 prevents distortion of the sound source by selecting one of a plurality of loudspeaker sets. The method of calculating a distance between a visual object and a loudspeaker is described above.

In the screen sound source positioning apparatus 100 according one example, when a plurality of loudspeaker sets include loudspeakers disposed at vertices of a virtual polygon whose centroid is at the position of a visual object displayed on the screen of a display, the controller 120 selects a loudspeaker set having the smallest of maximum angles between a virtual screen sound source reference vector from a viewer to the visual object and virtual loudspeaker vectors from a user to respective loudspeakers. Thus, the screen sound source positioning apparatus 100 prevents distortion of the sound source by selecting one of a plurality of loudspeaker sets.

Figure 5:
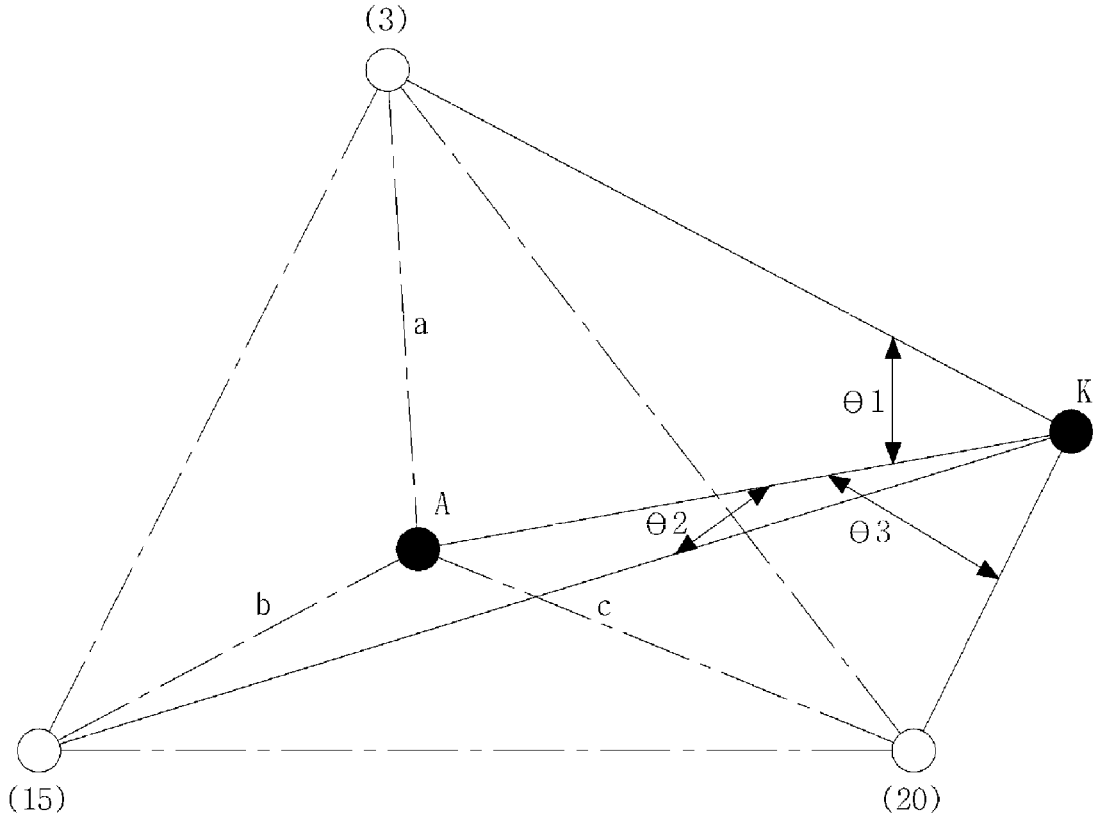
FIG. 5 is a diagram illustrating exemplary virtual vectors for processing loudspeakers disposed at vertices of a virtual polygon whose centroid is at the position of a visual object.

Referring to FIG. 5, it is assumed that angles between a virtual screen sound source reference vector from a user K to a visual object position A and virtual loudspeaker vectors from the user K to respective loudspeakers disposed at vertices of a virtual triangle whose centroid is at the visual object position A are θ1, θ2, and θ3. FIG. 5 illustrates exemplary virtual vectors for processing loudspeakers disposed at vertices of a virtual polygon whose centroid is at the position of a visual object.

Angles θ1, θ2, and θ3 are calculated from respective loudspeakers included in each of a plurality of detected loudspeaker sets, the maximum values of θ1, θ2, and θ3 calculated from each loudspeaker set are compared, and a loudspeaker set having the smallest maximum is selected. Thus, one loudspeaker set may be selected from a plurality of detected loudspeaker sets. The position of the user K may be determined by, for example, selecting a position in a direction perpendicular to the visual object position A.

In the screen sound source positioning apparatus 100 according to another example, when a plurality of loudspeaker sets include loudspeakers disposed at vertices of a virtual polygon whose centroid is at the position of a visual object displayed on the screen of a display, the controller 120 may select a loudspeaker set having the smallest sum of angles between a virtual screen sound source reference vector from a user to the visual object and virtual loudspeaker vectors from the user to respective loudspeakers.

Referring to FIG. 5, θ1, θ2, and θ3 are calculated from respective loudspeakers included in each of a plurality of detected loudspeaker sets and summed, and a loudspeaker set having the smallest sum is selected. Accordingly, one loudspeaker set may be selected from a plurality of detected loudspeaker sets.

In the screen sound source positioning apparatus 100 according to another example, when a plurality of loudspeaker sets include loudspeakers disposed at vertices of a virtual polygon whose centroid is at the position of a visual object displayed on the screen of a display, the controller 120 may select a loudspeaker set having the smallest average of angles between a virtual screen sound source reference vector from a user to the visual object and virtual loudspeaker vectors from the user to respective loudspeakers.

Referring to FIG. 5, θ1, θ2, and θ3 are calculated from respective loudspeakers included in each of a plurality of detected loudspeaker sets and averaged, and a loudspeaker set having the smallest average is selected. Accordingly, one loudspeaker set may be selected from a plurality of detected loudspeaker sets.

In the screen sound source positioning apparatus 100 according to another example, when a plurality of loudspeaker sets include loudspeakers disposed at vertices of a virtual polygon whose centroid is at the position of a visual object displayed on the screen of a display, the controller 120 may be implemented to select a loudspeaker set in which the virtual polygon formed by connecting loudspeakers included in the loudspeaker set has the smallest area.

Referring to FIG. 5, the area of a virtual triangle having vertices at loudspeakers included in each loudspeaker set having the visual object position A at its centroid is calculated, and a loudspeaker set having the smallest calculated area is selected. Accordingly, one loudspeaker set may be selected from a plurality of loudspeaker sets.

Additionally, if two loudspeakers have the same distance from a visual object displayed on the screen of a display and are disposed in a straight line, a virtual screen sound source may be positioned in synchronization with the visual object using only two loudspeakers.

In the screen sound source positioning apparatus 100 according to the above example, the controller 120 is implemented to select a loudspeaker set including two loudspeakers which have the same distance from a visual object displayed on the screen of a display and are disposed in a straight line.

Referring to FIG. 3, when the distance d between position B and loudspeaker 6 is the same as the distance e between position B and loudspeaker 20, speaker 6 and speaker 20 are disposed in a straight line and thus are selected as a loudspeaker set. Accordingly, a virtual screen sound source may be positioned in synchronization with a visual object displayed at a position on the screen of a display using only two loudspeakers.

However, if no two loudspeakers both have the same distance from a visual object displayed on the screen of a display and are disposed in a straight line, and if no loudspeaker set includes loudspeakers disposed at vertices of a virtual polygon whose centroid is at the position of the visual object displayed on the screen of the display, a virtual screen sound source may be positioned in synchronization with the visual object displayed at a certain position on the screen of the display as described below.

In the screen sound source positioning apparatus 100 according to one example, when no loudspeaker set includes loudspeakers disposed at vertices of a virtual polygon whose centroid is at the position of a visual object displayed on the screen of a display, the controller 120 selects a loudspeaker set including loudspeakers disposed at vertices of a virtual polygon whose centroid is nearest to the position of the visual object.

Here, the controller 120 finely adjusts the output gains of loudspeakers included in the selected loudspeaker set, thereby correcting distortion of the sound source caused by the difference in distances of the loudspeakers included in the selected loudspeaker set from the position of the visual object.

According to a method of positioning a virtual screen sound source by adjusting the gains of a plurality of loudspeakers having different distances from a virtual sound source, a distance between the position of a visual object and one of loudspeakers included in a selected loudspeaker set is described as a reference distance, distances between the position of the visual object and the other loudspeakers are compared with the reference distance, and the gains of the loudspeakers are increased or decreased according to the differences.

Figure 6:
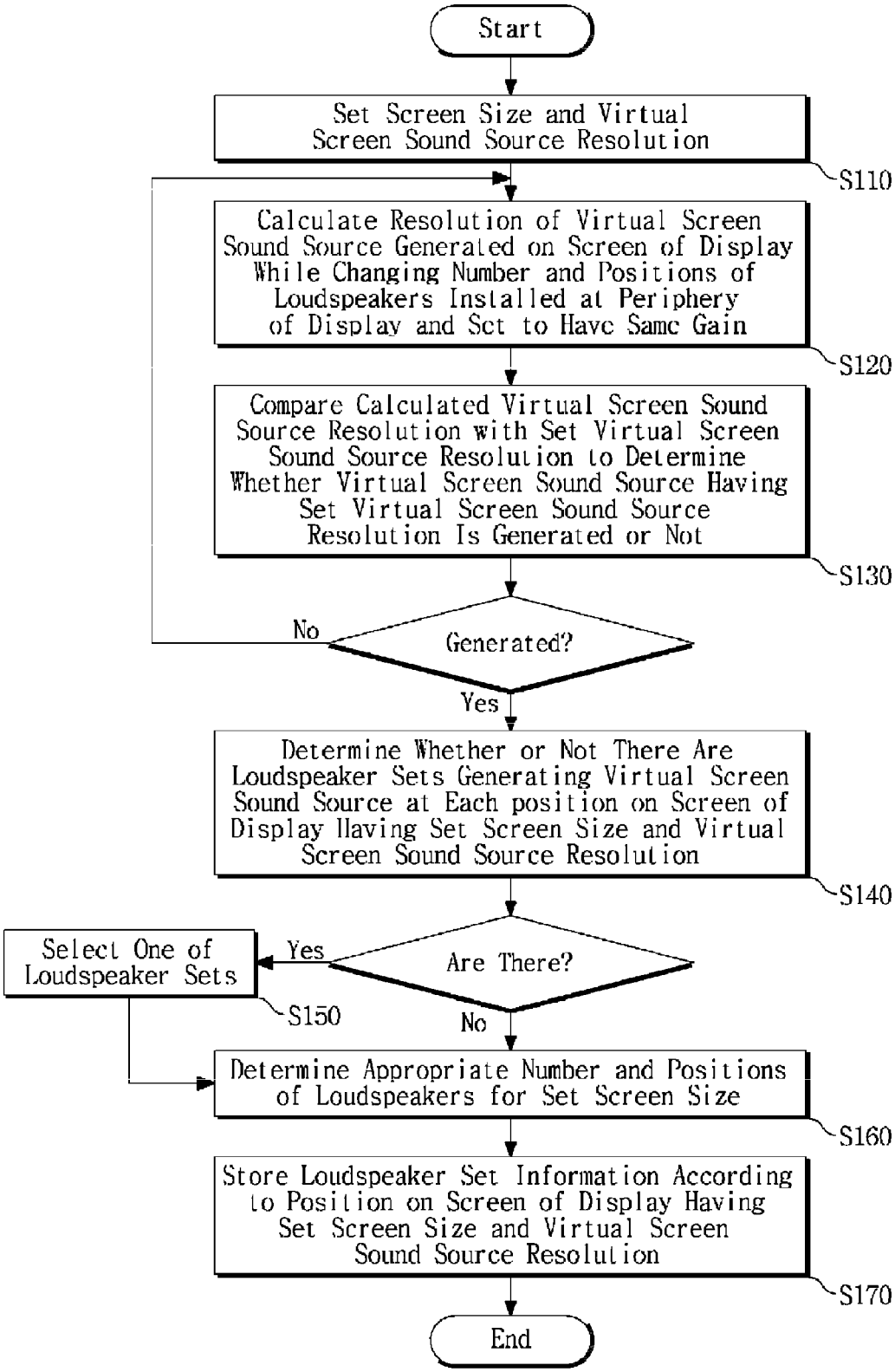
FIG. 6 is a flowchart illustrating an exemplary method of generating loudspeaker set information for screen sound source positioning.

A loudspeaker set information generation operation for screen sound source positioning and a positioned screen sound source reproduction operation of the screen sound source positioning apparatus 100 having the above-described constitution is described below with reference to FIGS. 6 to 8.

The loudspeaker set information generation operation for screen sound source positioning will be described with reference to FIG. 6. FIG. 6 is a flowchart illustrating an exemplary method of generating loudspeaker set information for screen sound source positioning. The method of generating loudspeaker set information for screen sound source positioning according to one example may be implemented by, for example, software installed and executed in a memory of a screen sound source positioning apparatus.

In operation S110, a screen sound source positioning apparatus sets a screen size and a virtual screen sound source resolution. In operation S120, the resolution of a virtual screen sound source generated on the screen of a display is calculated by the screen sound source positioning apparatus while changing the number and the position of a plurality of loudspeakers installed at the periphery of the display and set to have the same gain.

When the resolution of a virtual screen sound source generated on the screen of the display is calculated in operation S120, the screen sound source positioning apparatus compares the calculated virtual screen sound source resolution with the set virtual screen sound source resolution in operation S130, thereby determining whether a virtual screen sound source having the set virtual screen sound source resolution is generated or not.

When it is determined in operation S130 that a virtual screen sound source having the set virtual screen sound source resolution is generated, the screen sound source positioning apparatus determines in operation S140 whether there are a plurality of loudspeaker sets generating a virtual screen sound source at each position on the screen of the display having the set screen size and virtual screen sound source resolution.

When it is determined in operation S140 that there are a plurality of loudspeaker sets generating a virtual screen sound source at a certain position, the screen sound source positioning apparatus selects one of the loudspeaker sets in operation S150. The method of selecting one of a plurality of loudspeaker sets is described above.

When it is determined in operation S140 that there are not a plurality of loudspeaker sets generating a virtual screen sound source at a certain position, or when it is determined in operation S140 that there are a plurality of loudspeaker sets generating a virtual screen sound source at a certain position and one of the loudspeaker sets is selected in operation S150, the screen sound source positioning apparatus determines out the appropriate number and positions of loudspeakers for the set screen size in operation S160.

In operation S170, the screen sound source positioning apparatus stores loudspeaker set information according to each position on the screen of the display having the screen size and virtual screen sound source resolution. The loudspeaker set information generated and stored is accessed in the lookup table-based loudspeaker set selection method, which is described below.

Figure 7:
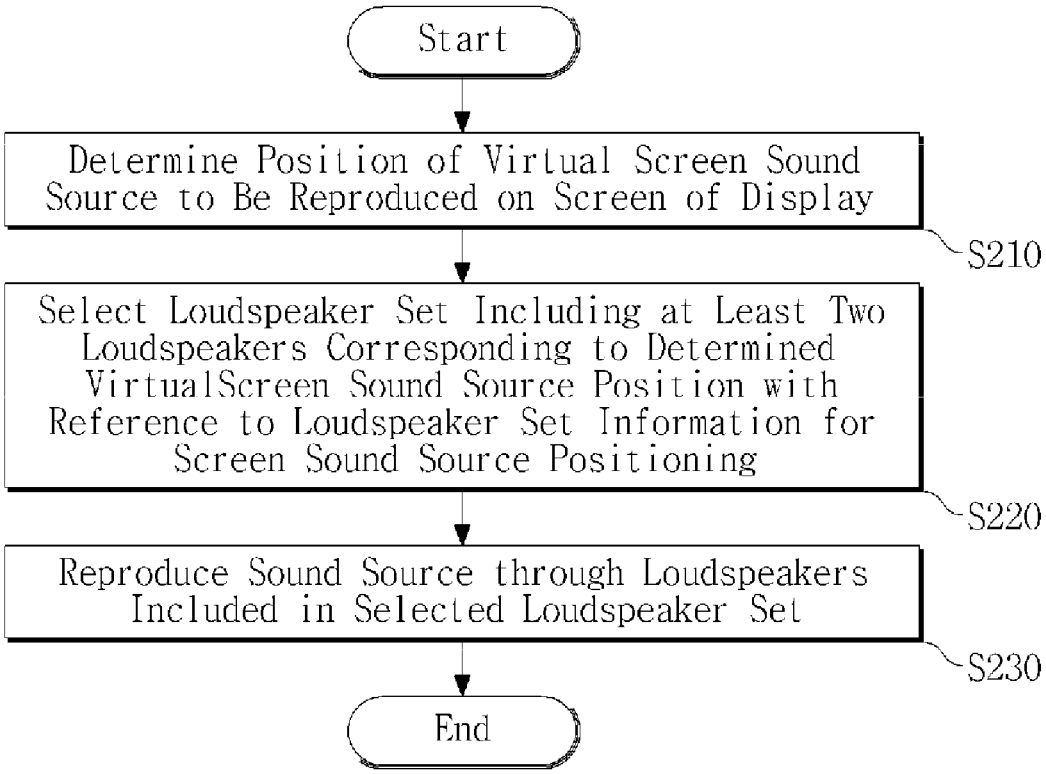
FIG. 7 is a flowchart illustrating an exemplary method of reproducing a positioned screen sound source.

FIG. 7 is a flowchart illustrating an exemplary method of reproducing a positioned screen sound source. One exemplary method relates to a technique for reproducing a screen sound source positioned using the lookup table-based loudspeaker set selection method, and may be implemented by, for example, software installed and executed in a memory of a screen sound source positioning apparatus.

When a sound source is input, the screen sound source positioning apparatus determines the position of a virtual screen sound source to be reproduced on the screen of a display in operation S210. For example, the screen sound source positioning apparatus may analyze output visual information, extract a visual object for synchronization with the virtual screen sound source to be reproduced, calculate information with respect to the position of the extracted visual object on the screen, and determine the position of the virtual screen sound source to be reproduced from the calculated position information.

When the position of the virtual screen sound source is determined in operation S210, the screen sound source positioning apparatus selects a loudspeaker set including at least two loudspeakers corresponding to the determined virtual screen sound source position with reference to loudspeaker set information for screen sound source positioning in operation S220.

The method of generating the loudspeaker set information and the method of selecting a loudspeaker set including at least two of a plurality of loudspeakers to position a virtual screen sound source to be synchronized with a visual object with reference to loudspeaker set information are described above.

When a loudspeaker set is selected in operation S220, the screen sound source positioning apparatus reproduces the sound source through the loudspeakers included in the selected loudspeaker set in operation S230.

At least two loudspeakers are selected from among a plurality of loudspeakers installed at the periphery of the display and set to have the same gain, and a virtual screen sound source is positioned in synchronization with a visual object displayed at a certain position on the screen of the display, such that a user hears the sound source as if the sound source is reproduced from the visual object without distortion.

Further, even if the position of the visual object shown on the screen of the display varies in real time and another loudspeaker set is selected, a virtual screen sound source may be positioned at a certain position on the screen of the display without sound source distortion because all the loudspeakers installed at the periphery of the display are set to have the same gain.

Figure 8:
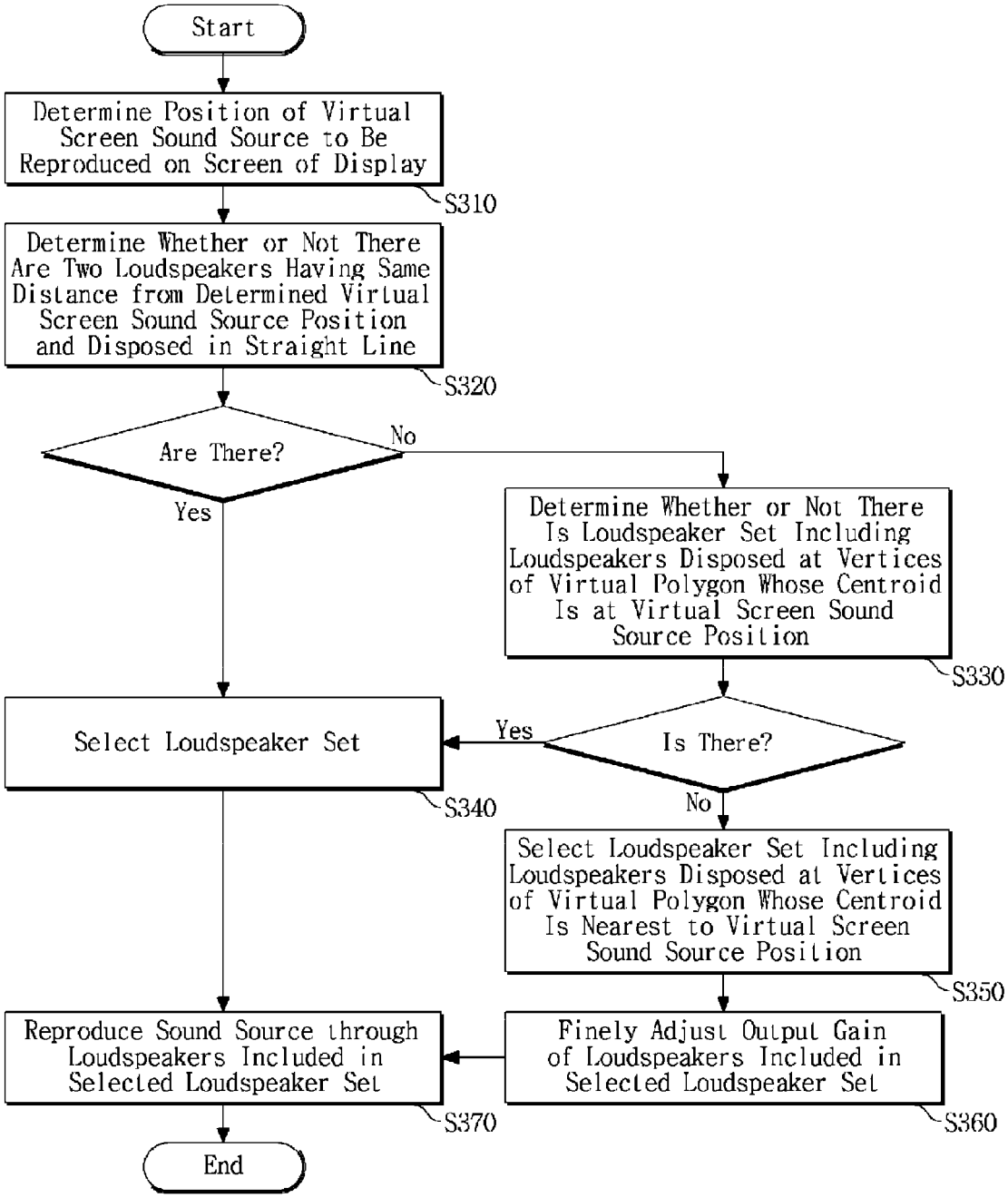
FIG. 8 is a flowchart illustrating an exemplary method of reproducing a positioned screen sound source.

FIG. 8 is a flowchart illustrating an exemplary method of reproducing a positioned screen sound source. One exemplary method relates to a technique for reproducing a screen sound source positioned using the real-time computation-based loudspeaker set selection method, and can be implemented by, for example, software installed and executed in a screen sound source positioning apparatus.

When a sound source is input, a screen sound source positioning apparatus determines the position of a virtual screen sound source to be reproduced on the screen of a display in operation S310. For example, the screen sound source positioning apparatus may analyze output visual information, extract a visual object for synchronization with the virtual screen sound source to be reproduced, calculate information with respect to the position of the extracted visual object on the screen, and determine the position of the virtual screen sound source to be reproduced from the calculated position information.

When the position of the virtual screen sound source is determined in operation S310, the screen sound source positioning apparatus determines in operation S320 whether two loudspeakers have the same distance from the determined virtual screen sound source position and are disposed in a straight line.

When it is determined in operation S320 that no two loudspeakers have the same distance from the determined virtual screen sound source position and are disposed in a straight line, the screen sound source positioning apparatus determines in operation S330 whether a loudspeaker set includes loudspeakers disposed at vertices of a virtual polygon whose centroid is at the determined virtual screen sound source position.

When it is determined in operation S320 that two loudspeakers have the same distance from the determined virtual screen sound source position and are disposed in a straight line, or when it is determined in operation S330 that a loudspeaker set includes loudspeakers disposed at vertices of a virtual polygon whose centroid is at the determined virtual screen sound source position, the screen sound source positioning apparatus selects the corresponding loudspeaker set in operation S340.

When a plurality of loudspeaker sets includes loudspeakers disposed at vertices of a virtual polygon whose centroid is at the virtual screen sound source position, one of the loudspeaker sets is selected in operation S340. The method of selecting one of a plurality of loudspeakers sets is described above.

When it is determined in operation S330 that no loudspeaker set includes loudspeakers disposed at vertices of a virtual polygon whose centroid is at the determined virtual screen sound source position, the screen sound source positioning apparatus selects a loudspeaker set including loudspeakers disposed at vertices of a virtual polygon whose centroid is nearest to the determined virtual screen sound source position in operation S350.

When a loudspeaker set including loudspeakers disposed at vertices of a virtual polygon whose centroid is nearest to the virtual screen sound source position is selected in operation S350, the screen sound source positioning apparatus adjusts the output gains of loudspeakers included in the selected loudspeaker set in operation S360. The method of adjusting the output gains of loudspeakers included in a loudspeaker set is described above.

When a loudspeaker set is selected in operation S340, or when a loudspeaker set including loudspeakers disposed at vertices of a virtual polygon whose centroid is nearest to the virtual screen sound source position is selected in operation S350 and the output gains of loudspeakers included in the selected loudspeaker set are adjusted in operation S360, the screen sound source positioning apparatus reproduces the sound source through the plurality of loudspeakers included in the selected loudspeaker set in operation S370.

Accordingly, at least two loudspeakers are selected from among a plurality of loudspeakers installed at the periphery of the display and set to have the same gain, and a virtual screen sound source is positioned in synchronization with a visual object displayed at a certain position on the screen of the display, such that a user hears the sound source as if the sound source is reproduced from the visual object without distortion.

Moreover, even if the position of the visual object shown on the screen of the display varies in real time and another loudspeaker set is selected, a virtual screen sound source may be positioned at a certain position on the screen of the display without sound source distortion because all the loudspeakers installed at the periphery of the display are set to have the same gain.

As apparent from the above description, example embodiments may position a virtual sound source in spatial synchronization with a visual object shown at a certain position on the screen of a display without sound source distortion, and also may position a virtual sound source in spatial synchronization with a visual object without sound source distortion even if the position of the visual object shown on the screen of the display varies.

The methods described above may be recorded, stored, or fixed in one or more computer-readable media that includes program instructions to be implemented by a computer to cause a processor to execute or perform the program instructions. The media may also include, alone or in combination with the program instructions, data files, data structures, and the like. Examples of computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for positioning a screen sound source, the apparatus comprising:

a plurality of loudspeakers, each disposed proximate to the edge of a display and each configured to have approximately the same gain; and a controller configured to select a loudspeaker set, including at least two of the loudspeakers, to position a virtual screen sound source substantially synchronized with a visual object displayed at a position on a screen of the display, wherein, the controller selects the loudspeaker set with reference to loudspeaker set information configured according to the position of the visual object on the screen of the display, and in response to no two speakers having the same distance to the position of the visual object on the screen, the controller selects a loudspeaker set including loudspeakers disposed at vertices of a virtual polygon whose centroid is at the position of the visual object on the screen of the display.

2. The apparatus of claim 1, wherein if a plurality of loudspeaker sets includes loudspeakers disposed at vertices of a virtual polygon whose centroid is at the position of the visual object on the screen of the display, the controller selects the loudspeaker set having the shortest distance between the visual object and each of the loudspeakers.

3. The apparatus of claim 1, wherein if a plurality of loudspeaker sets includes loudspeakers disposed at vertices of a virtual polygon whose centroid is at the position of the visual object on the screen of the display, the controller selects the loudspeaker set having the lowest of maximum angles between a virtual screen sound source reference vector from a user to the visual object and virtual loudspeaker vectors from the user to each of the loudspeakers.

4. The apparatus of claim 1, wherein if a plurality of loudspeaker sets includes loudspeakers disposed at vertices of a virtual polygon whose centroid is at the position of the visual object on the screen of the display, the controller selects the loudspeaker set having the lowest sum of angles between a virtual screen sound source reference vector from a user to the visual object and virtual loudspeaker vectors from the user to each of the loudspeakers of each loudspeaker set.

5. The apparatus of claim 1, wherein if a plurality of loudspeaker sets includes loudspeakers disposed at vertices of a virtual polygon whose centroid is at the position of the visual object on the screen of the display, the controller selects the loudspeaker set having the lowest average of angles between a virtual screen sound source reference vector from a user to the visual object and virtual loudspeaker vectors from the user to each of the loudspeakers of each loudspeaker set.

6. The apparatus of claim 1, wherein if a plurality of loudspeaker sets includes loudspeakers disposed at vertices of a virtual polygon whose centroid is at the position of the visual object On the screen of the display, the controller selects the loudspeaker set having the smallest area of a virtual polygon formed by connecting each of the loudspeakers included in the loudspeaker set.

7. The apparatus of claim 1, wherein if no loudspeaker set includes loudspeakers disposed at vertices of a virtual polygon whose centroid is at the position of the visual object on the screen of the display, the controller selects a loudspeaker set including loudspeakers disposed at vertices of a virtual polygon whose centroid is nearest to the position of the visual object.

8. The apparatus of claim 7, wherein the controller adjusts output gains of the loudspeakers included in the selected loudspeaker set.

9. A method of generating loudspeaker set information for screen sound source positioning, the method comprising:

selecting a screen size and a virtual screen sound source resolution;

calculating a resolution of a virtual screen sound source generated on a screen of a display with respect to a variable number and a variable position of a plurality of loudspeakers disposed proximate to the edge of the display and each configured to have approximately the same gain;

comparing the calculated virtual screen sound source resolution with the selected virtual screen sound source resolution, and, according to the result, determining if a virtual screen sound source having the selected virtual screen sound source resolution is generated;

if it is determined that a virtual screen sound source having the set virtual screen sound source resolution is generated, further determining a quantity and positions of loudspeakers for the selected screen size; and storing loudspeaker set information according to each position on the screen of the display having the selected screen size and virtual screen sound source resolution.

10. The method of claim 9, further comprising:

determining if a plurality of loudspeaker sets generates a virtual screen sound source at each position on the screen of the display having the selected screen size and virtual screen sound source resolution.

11. The method of claim 10, further comprising:

if it is determined that a plurality of loudspeaker sets generates a virtual screen sound source at a certain position, selecting one of the loudspeaker sets.

12. A method of reproducing a positioned screen sound source, comprising:

in response to a sound source being input, determining a position of a virtual screen sound source on a screen of a display;

in response to the virtual screen sound source position being determined, selecting a loudspeaker set including at least two loudspeakers corresponding to the determined virtual screen sound source position, with reference to loudspeaker set information for screen sound source positioning; and outputting the sound source through the loudspeakers included in the selected loudspeaker set, wherein, the loudspeaker set is selected with reference to loudspeaker set information configured according to the position of the visual object on the screen of the display, and in response to no two speakers having the same distance to the position of the visual object on the screen, a loudspeaker set is selected which includes loudspeakers disposed at vertices of a virtual polygon whose centroid is at the position of the visual object on the screen of the display.

13. A method of reproducing a positioned screen sound source, the method comprising:

in response to a sound source being input, determining a position of a virtual screen sound source on a screen of a display; determining that no two speakers have the same distance to the virtual screen sound source position and that —a loudspeaker set includes loudspeakers disposed at vertices of a virtual polygon that has a centroid that is at the determined virtual screen sound source position;

selecting the loudspeaker set that which includes loudspeakers disposed at the vertices of a virtual polygon whose centroid is at the position of the virtual object on the screen display; and outputting the sound source through the loudspeakers included in the selected loudspeaker set;

wherein the loudspeaker set is selected with reference to loudspeaker set information configured according to the position of the visual object on the screen of the display.

14. The method of claim 13, further comprising:

if it is determined that no loudspeaker set includes loudspeakers disposed at vertices of a virtual polygon whose centroid is at the determined virtual screen sound source position, selecting a loudspeaker set including loudspeakers disposed at vertices of a virtual polygon whose centroid is nearest to the determined virtual screen sound source position.

15. The method of claim 14, wherein if the loudspeaker set including loudspeakers disposed at vertices of a virtual polygon whose centroid is nearest to the virtual screen sound source position is selected, output gains of the loudspeakers included in the selected loudspeaker set are adjusted.

16. An apparatus for positioning a sound source on a display, the apparatus comprising:

a plurality of loudspeakers that are disposed around the edge of the display and each configured to have approximately the same gain; and a controller configured to select a loudspeaker set including at least three of the loudspeakers to approximately align the sound source and an object displayed on the display;

wherein the controller selects the loudspeaker set with reference to loudspeaker set information configured according to the position of the visual object on the screen of the display, and in response to no two speakers having the same distance to the position of the visual object on the screen, the controller selects a loudspeaker set including loudspeakers disposed at vertices of a virtual polygon whose centroid is at the position of the visual object on the screen of the display.

* * * * *